United States Patent [19]

Meltzer et al.

[11] 4,005,438

[45] Jan. 25, 1977

[54] DEVICE WITH CONTROL GRID FOR ELECTROSTATOGRAPHIC REPRODUCTION OF AN OPTICAL IMAGE

[75] Inventors: David W. Meltzer, Miami, Fla.
Narendra S. Goel, Henrietta, N.Y.

[73] Assignee: Xerox Corporation, Stamford, Conn.

[22] Filed: May 27, 1975

[21] Appl. No.: 581,011

[52] U.S. Cl. ..... 346/158; 346/160

[51] Int. Cl.[2] ..... G03G 15/04

[58] Field of Search ..... 346/74 ES, 74 EB, 74 J, 346/74 S, 74 P; 178/6.6 A

[56] References Cited

UNITED STATES PATENTS

| | | | |
|---|---|---|---|
| 3,368,106 | 2/1968 | Berthold | 346/74 P |
| 3,419,888 | 12/1968 | Levy | 346/74 J |
| 3,495,267 | 2/1970 | Brodie | 346/74 P |
| 3,787,876 | 1/1974 | Pressman | 346/74 J |

OTHER PUBLICATIONS

IBM Tech. Disc. Bull., vol. 15, No. 2 p. 575, July, 1972, *Output Control for Ionic Print Head*, R. E. McCurry & C. A. Speicher.

*Primary Examiner*—Jay P. Lucas

[57] ABSTRACT

Apparatus and method for converting an optical image into an electrostatographic image. A vacuum tube device has a source of electrons which can deposit electrostatic charge on an array of conductors coupling an exterior surface of the vacuum tube device with an exterior surface. A photoconducting electrode, interposed between the electron source and the conductor array, is charged by depositing electrons thereon in the absence of conductivity inducing radiation. The deposited electronic charge is selectively removed by applying an optical image to the photosensitive device, the removal of deposited charge being a function of the radiation intensity of related portions of the applied image. The conductor array is thereafter flooded with electrons, the amount of charge reaching the conductor array depending on the unremoved charge remaining on an associated region of the photosensitive electrode.

The charge on the external region of the conductor array can be transferred to a suitable medium and the resulting electrostatic image developed to produce a reproduction of the original optical image.

13 Claims, 5 Drawing Figures

DEVICE WITH CONTROL GRID FOR ELECTROSTATOGRAPHIC REPRODUCTION OF AN OPTICAL IMAGE

This invention relates generally to devices for converting optical images to electrostatic images and more particularly to vacuum tube devices in which localized regions of a control grid determine the density of electrons reaching related portions of a target area.

It is known in the prior art that a control grid, utilizing a photoconducting surface, can provide modulation of a stream of electrons in a manner such as to amplify an electrostatic image on the photoconductive surface, c.f. U.S. Pat. No. 2,712,607 issued on July 5, 1955 to C. Orlando. In this patent, no convenient method is disclosed by which the electrostatic image found on the photoconducting surface can be changed. Thus, utilizing the disclosed apparatus to provide for reproduction of a multiplicity of documents would involve complicated apparatus or complex and time consuming manual procedures. In addition, there is no indication of a method by which the disclosed apparatus could provide an output electrostatic image for use in an electrostatographic reproduction process.

It is also known in the prior art to provide a visual display utilizing a photosensitive control grid, upon which an electrostatic image has been applied to modulate electrons produced by secondary emission, c.f. U.S. Pat. No. 3,784,831 issued in January 1974 to Reif. The electrons produced secondary emissive portion are amplified to provide a visual display on a cathode ray screen. However, the use of a plurality of electron multiplicative devices greatly increases the complexity of the apparatus, while severely limiting the resolution. Furthermore, no method of producing an electrostatic image from an optical image is described.

It is also known in the prior art to utilize a cathode ray tube in conjunction with face plate having an array of conductors joining interior surface of the tube with an exterior surface. The impinging electrons cause an electrostatic potential voltage to accumulate on the external surface. The electrostatic charge can be transferred to an associated medium and the image subsequently developed by xerographic or other techniques. This class of cathode ray tube devices has been described in an article by Crews et al., "IRE Transactions of Electron Devices", September 1961, Pages 406–414. However, in order to provide an electrostatic reproduction of an optical image utilizing this device, the information in an optical image must first be converted to appropriate electrical signals. The resulting electrical signals modulate the beam of electrons produced by the cathode ray tube striking the target area. The intermediate step of image conversion to electrical signals can be complex, can be prohibitive in expense, and can require an unacceptable time to provide an electrostatic reproduction of an optical image.

It is therefore an object of the present invention to provide an improved device for converting an optical image to an electrostatic image.

It is a further object of the present invention to provide a device for converting an optical image to an electrostatic image without converting the optical image to related electrical signals.

It is still a further object of the present invention to provide means for storing the information contained in an optical image on a control grid, whereby a plurality of electrostatic replicas of optical image can be applied to an associated medium without refreshing the physical properties of the control grid.

It is a more particular object of the present invention to provide a control grid, responsive to optical images focused thereon, for modulating electrons impinging on an array of conductors, the array of conductors electrically coupled to a medium upon which an electrostatic image is to be applied.

It is a still further particular object of the present invention to provide a photoconductive control grid interposed between a source of electrons and an array of conductors, wherein the distribution of charge applied on the array of conductors is determined by charge stored on the photoconductive control grid.

It is yet another object of the present invention to provide devices for producing a plurality of electrostatic copies of an optical image by controlling the distribution of electronic charge on an array of conductors by means of a photoconductive element interposed between a source of electrons and the array of conductors, wherein uniform charge deposited the photoconductor element has been altered by an optical image applied to the photoconductive element.

The aforementioned and other objects of the present invention are accomplished by a vacuum tube device including a source of electrons, an array of conducting electrodes coupling an interior surface with an exterior surface of the vacuum tube device, a control grid including a photoconducting portion interposed between the electron source and the conductor array, and a window in the vacuum device for applying an optical image external to the vacuum device to the photoconducting portion of the control grid.

The photoconductor portion of the control grid is initially charged with electrons from the electron source. An optical image, for which an electrostatic replica is to be provided, is applied to the control grid. The amount of stored electronic charge dispersed by means of increased photoconductivity of the control grid is determined by the intensity of the radiation impinging on localized region of the control grid. The source of electrons is then utilized to flood the interior surface of the conductor array. The electrostatic charge reaching the conductor array is a function of the stored charge remaining on the control grid. The electrostatic charge is transferred to the exterior surface by the conductor array. The resulting electrostatic charge on the exterior of the vacuum tube device can then be transferred to an adjacent medium.

These and other features of this invention will be understood upon the reading of the following description along with the drawings.

Figure 1:
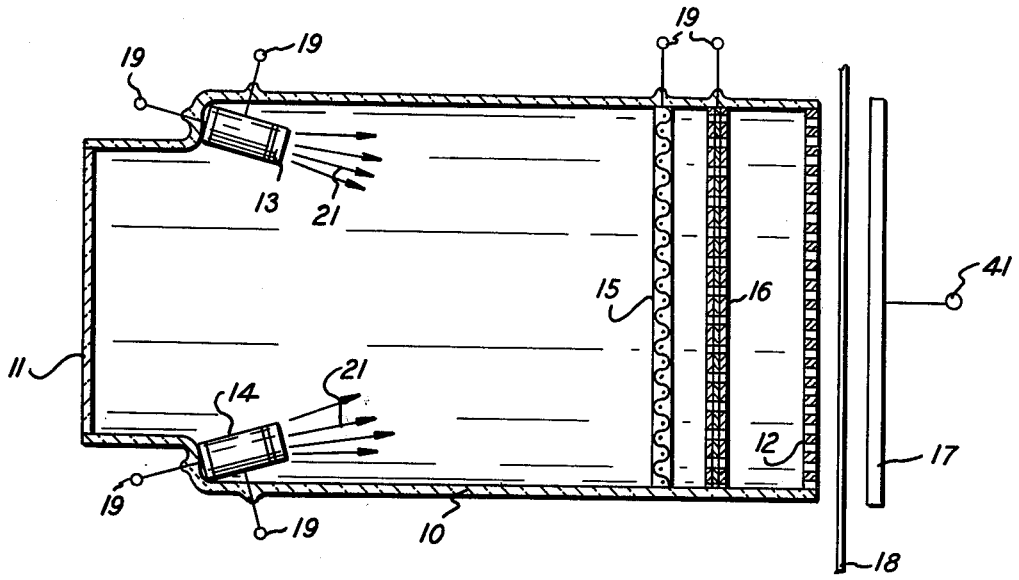
FIG. 1 is a cross-sectional view of an electrostatic image-forming device and associated apparatus.
Figure 2:
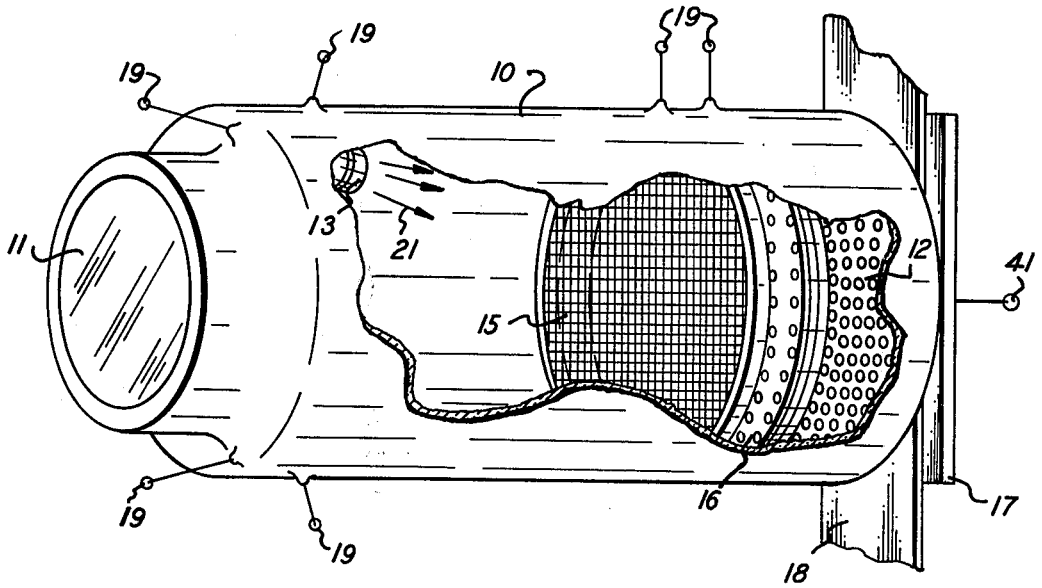
FIG. 2 is a cut-away perspective view of the electrostatic image-forming device and associated apparatus.

Referring now to FIG. 1 and FIG. 2, a schematic cross-sectional and a cut-away of perspective view of the vacuum tube device 10, according to the present invention, are shown. An array of conducting elements 12 electrically couple an interior surface of device 10 with an exterior surface. The conducting elements of array 12 are electrically insulated from one another. Located near conductor array 12 in the interior of device 10, is a control electrode 16 which is comprised of a supportive substrate, a conductive material and a photoconductive material. Electrode 16 is structured to permit passage of charged particles therethrough. Electrode 15, located in the vicinity of electrode 16, is typically a wire mesh and is utilized for collecting and preventing the accumulation of space charge near control electrode 16. Similarly, an electrode for collection of space charge can be located in the vicinity of array 12. Electron source devices 13 and 14 are typically cathode ray guns and associated control electrodes. Window 11 provides an optical access, for applying electromagnetic radiation to control electrode 16. Window 11 can include image-forming apparatus, such as a lens. Apparatus for forming an image, in the alternative, can be located either in whole or in part in the interior or exterior of the vacuum tube device 10. Arrows 21 provide a schematic indication of the direction of the electrons propagating from the electron source to conductive array 12. Terminals 19 provide electrical coupling between the exterior region of vacuum device 10 and the interior elements of device 10. Vacuum tube device 10 is maintained at an internal pressure sufficiently low to insure that collisions by electrons with remaining gas particles do not appreciably affect the device operation.

Electrode 17, located near the exterior portion of conductor matrix 12, upon application of an appropriate potential to the terminal 41 coupled to electrode, provides a multiplicity of capacitors with the individual conductors of array 12. The medium to which a latent electrostatic image is to be transferred, is designated as material 18. Material 18 can be a copy sheet material upon which the latent electrostatic image can be processed or can be an intermediate material from which a developed latent electrostatic image is transferred to the copy sheet material before further processing. The medium 18 can be in contact with the conductor array 12 during the transfer of the latent electrostatic image or the image transfer can take place by electrical discharge. After contract transfer of the latent image, material 18 is removed from contact with array 12.

Figure 3:
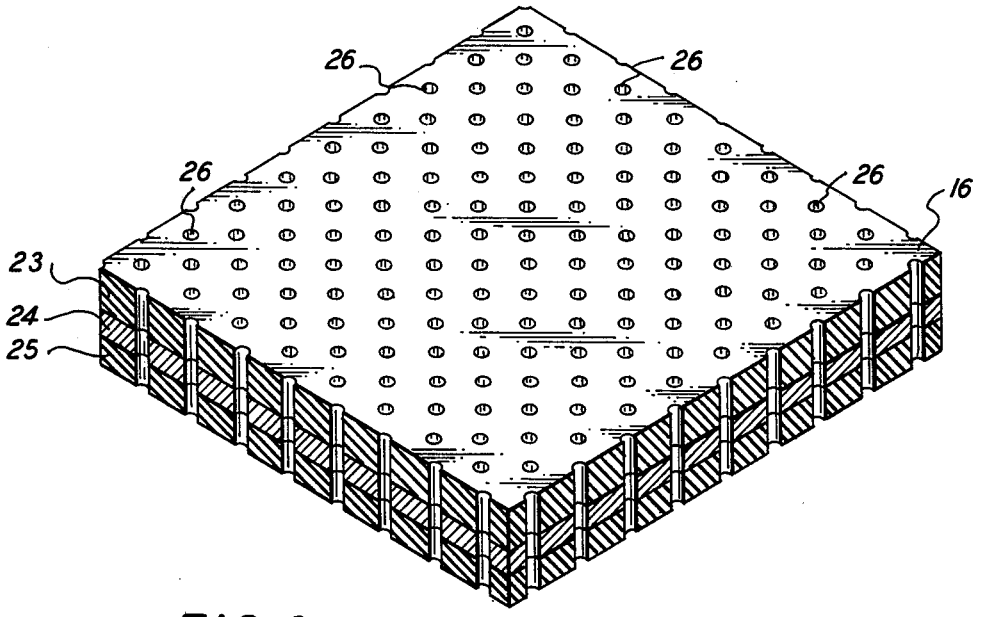
FIG. 3 is a perspective view of the control electrode of the electrostatic image-forming device according to one embodiment.

Referring next to FIG. 3, one embodiment of control electrode 16 is shown. Supportive substrate layer 25 provides the structural support for the control electrode. Conductive layer 24 is electrically coupled to an associated external electrode 19. Layer 23 is comprised of a photoconducting material in the preferred embodiment and is positioned on control electrode 16 to be facing the source of electrons. A plurality of apertures 26 are located in control electrode 16 to permit passage electrons therethrough. Other configurations for control electrode 16 will be clear to those skilled in the art. For example, the photoconductive material can be applied to one side of a wire mesh. In this embodiment, the wire mesh provides both the conducting region for electrically coupling to an associated external terminal 19 as well as structural support. In addition, the configuration of the mesh provides a multiplicity of apertures.

Figure 4:
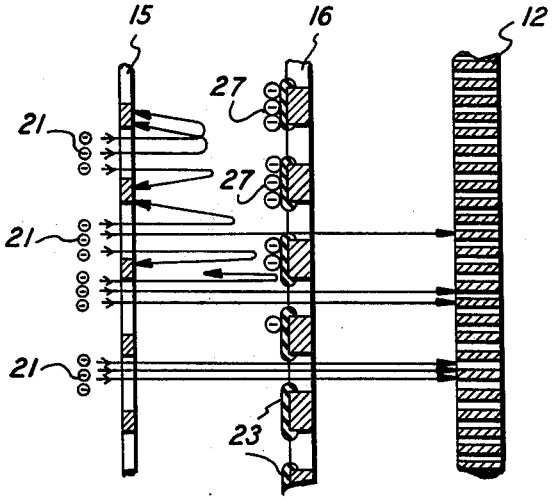
FIG. 4 is a schematic diagram showing the method by which the control electrode of the electrostatic image-forming device modulates electrons traversing the control electrode.

Referring next to FIG. 4, a schematic illustration of the mechanism by which the control electrode 16 modulates the passage of electrons is shown. Control electrode 16, shown in cross-section, has a varying amount of charge, indicated by charges 27, stored on the photoconducting layer 23 of electrode 16. Electrons 21 are propagated toward conductor array 12. Electrode 15 in general maintained at a potential a few volts above ground potential intercepts an insignificant portion of the impinging electrons. Most of the electrons continue past electrode 15 toward electrode 16. The conducting region of control electrode is generally near ground potential. The presence of negative charges 27, trapped on the photoconductor, is equivalent to a negative potential. The negative potential tends to deflect the impinging electrons 21, the influence being a function of the magnitude of stored charge and the average velocity of the incident electrons. Thus, the amount of charge passing through each aperture of the control electrode 16 and reaching the conducting array 12 is determined by density of charge in the region of each aperture control electrode 16.

Figure 5:
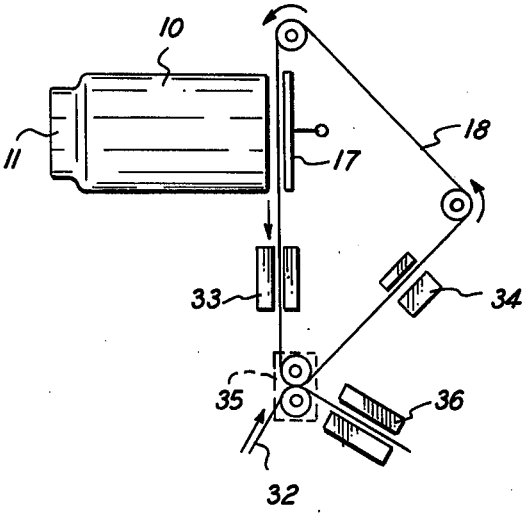
FIG. 5 is a schematic diagram of the incorporation of the electrostatic image-forming device in an electrostatographic reproduction system.

Referring next to FIG. 5, a schematic diagram of an electrostatographic copy system utilizing the vacuum tube device of the instant invention is shown. An optical image is applied to the photoconducting portion of electrode 16 of device 10 through window 11 producing a master latent electrostatic image. Device 10 thereafter applies a latent electrostatic image, determined by the master electrostatic image, to dielectric medium 18. The latent electrostatic image can be developed at station 33 and the developed image transferred to an appropriate copy sheet 32 at station 35 according to the well-known techniques of electrostatographic latent image processing. The transferred image can be fixed at station 36. The medium 18 can thereafter be cleaned and prepared for further electrostatic transfer at station 34. By way of example, medium 18 can be a suitable polymeric material and station 33 can apply appropriately charged ink droplets to medium 18. The image can be contact-transferred at transfer station 35 to copy sheet 32. Station 34 removes the remaining ink and remaining electrostatic charge and prepares the medium 18 for receipt of another electrostatic image. Dielectric medium 18 can be chosen to provide properties which would be difficult to achieve with the copy sheet material. It will be clear to those skilled in the art of electrostatic image processing that the particular embodiment of the processing stations will be determined by the particular electrostatographic image processing techniques utilized by the apparatus. It will be further clear that copy sheet 32 can be substituted for medium 18 between array 12 and electrode 17 and the electrostatic image directly applied to the copy sheet for development and fixing on the copy sheet without the requirement of an intermediate transfer medium 18.

The operation of the vacuum tube device 10 in forming an electrostatic image from an applied optical image depends on the imposition of a master electrostatic charge replica or master electrostatic latent image of the optical image on the control electrode 16. The electrostatic charge replica thereafter modulates the passage of electrons through apertures in the control electrode. The electrons passing through the control grid strike the array of conductors and the accumulation of electrons form another electrostatic replica or electrostatic latent image on the members of the conductor array. The electrostatic replica of the conductive array is then transferred for processing and fixing of the image.

In order to provide a latent electrostatic image from the optical image on electrode 16, the conducting portion 24 of control electrode 16 has initially a suitable potential applied thereto to attract electrons from the source of electrons. The electrons, attracted by the potential of the conducting portion 24, strike the photoconducting portion 23 of control electrode 16. The photoconducting portion 23 of the control electrode, not being illuminated, is an electrical insulator and the electrons impinging on the photoconducting portions are substantially trapped. In this manner, a generally uniform charge can be applied to control electrode 16.

An optical image is thereafter focused through window 11 on control electrode 16. The radiation of the the optical image impinging on electrode 16, causes the photoconducting portion of electrode 16 to become conducting, the localized change in conductivity depending on the local intensity of impinging radiation. The potential of the conducting portion 24 of the electrode 16 is held at a suitable potential to attract the previously trapped electronic charge and the charge can, under the influence of the radiation, propagate toward the conducting portion of electrode 16 and be removed from the device 10. The rate of removal of the locally stored electronic charge depends upon the local intensity of impinging radiation. The time of exposure of the image to the photoconducting portion of electrode 16 is arranged to provide a master electrostatic latent image determined by the optical image on the electrode.

After the optical image is removed, a master electrostatic charge replica or latent image of the applied image remains stored on the control electrode. The source of electrons is activated, flooding the vacuum tube device with electrons. The master electrostatic latent image stored on control electrode 16 modulates the local passage of electrons through apertures of electrode 16 to conductor array 12. Thus, the electrons reaching conductor array 12 and therefore the electrostatic latent image, produced by the charge stored on the multiplicity of conducting elements of array 12, provides this electrostatic image replica of the master latent image which can be transferred to medium 18.

The master electrostatic charge replica stored in the control electrode 16 will eventually deteriorate because of positive ions produced by collisions between propagating electrons and gas molecules. The positive ions can combine with the charge of the electrode, the combination gradually degrading the master electrostatic latent image. Other processes can also control the degradation of the master electrostatic latent image. Nonetheless, it is possible to produce a multiplicity of electrostatic image replicas on medium 18 before deterioration of the stored image on control electrode 16 results in unacceptable reproduction of the master electrostatic latent image.

The reproduction of the electrostatic image replica, stored on the control electrode 16 by the conductor array, is generally referred to as a "reading" of the stored information. Generally, the reading is accomplished according to the preferred embodiment by a diffuse beam of electrons capable of irradiating the entire area of the conductive array 12 with electrons. Generally, the density of the diffuse electron beam will be such that the medium 18 must be either stopped or traversing relatively slowly the exterior region of the conductor array 12. However, it will be clear that the electron guns can provide an intense focused beam which can read by scanning the focused beam on portions of the stored image of control electrode 16. Because this scanning can take place relatively rapidly, the medium 18 can be kept in synchronized motion vertical position of the reading electron beam. It is clear that the necessary focusing and deflecting electrodes must be included with the electron gun apparatus acting as the electron source.

In the preferred embodiment, apparatus can be added to the vacuum tube device when correction of the image stored on control electrode 16 is desired. Two methods can be utilized. A focused electron beam providing localized charge storage on the control electrode used in conjunction with a collimated radiation source, providing localized charge dissipation on the control electrode can be utilized to control the stored charge of a local region of the control electrode 16. A second method of local correction depends on the use of a focused electron beam in which the acceleration potential can be adjusted into a range resulting in secondary emission of the photoconducting material. The average number of emitted electrons resulting from secondary emission, can be greater than or less than the average number of electrons striking on photoconductive surface depending on the energy with which the electrons impact the photoconductive material. Thus, the stored charge can be increased or decreased providing alterations in the master electrostatic latent image in a localized region of the control electrode.

It will be clear to those skilled in the art that the pattern of the electrode 15, the pattern of the control electrode 16 and the pattern of the conductor elements of conductor array 12 must be chosen to minimize patterns in the electrostatic image stored on conductor array 12 resulting from interference between the various patterns.

According to another mode of operation, the voltages applied to the electron source and the control electrode can be adjusted, by means of the secondary emission process, so that a positive uniform charge (i.e., by the absence of electronic charge) can be stored on the control electrode. The application of the image, for which reproduction is desired, to the control electrode results in a reversed image electrostatic replica stored on the replica. After appropriate adjustment of control electrode potential, a reversed image electrostatic replica can be stored on the conductor array for subsequent transfer and development.

The above description is included to illustrate the operation of the preferred embodiment and is not meant to limit the scope of the invention. The scope of the invention is to be limited only by the following claims. From the above discussion, many variations will be apparent to those skilled in the art that would yet be encompassed by the spirit and scope of the invention.

What is claimed is:

1. Apparatus for converting an optical image to an electrostatic image comprising:

an enclosure for maintaining an internal pressure below atmospheric pressure;

an array of electrically conducting elements, forming one wall of said enclosure;

a source of electrons located in said enclosure, said electron source including means for propagating electrons generally toward said array of elements;

light sensitive means disposed between said electron source and said array of elements, said light sensitive means having a multiplicity of apertures permitting passage of electrons from said electron source through said light sensitive means to said array of elements; means for providing a substantially uniform charge distribution on said light sensitive means, and entrance means in said enclosure for permitting a radiation likeness of said optical image to be applied to said light sensitive means whereby said charge distribution on said light sensitive means is dissipated in accordance with the radiation likeness of said optical image.

2. The image converting apparatus of claim 1 wherein passage of electrons from said electron source through individual ones of said apertures is determined by the charge distribution on said light sensitive means in the vicinity of the individual apertures.

3. The image converting apparatus of claim 1 wherein said source of electrons includes means to selectively alter the charge distribution on said light sensitive means.

4. A device for generating electrostatic images including a housing, an array of conductors, said array of conductors electrically coupling the interior of said housing with the exterior; and a source of electrons disposed within said housing for generating electrons toward said conductor array, the improvement comprising:

a control grid in said housing for storing a substantially uniform charge distribution, said control grid being disposed between said source of electrons and said conductor array, whereby to control the distribution of electrons from said electron source onto said conductor array, and means for establishing a charge distribution on said control grid in conformance with an optical image.

5. The electrostatic image generating device of claim 4 in which:

said control grid includes a photoconductive layer.

6. A method for converting an optical image into an electrostatic image comprising the steps of:

charging an apertured photoconductive control grid with a generally uniform charge;

exposing said control grid to said optical image wherein to dissipate the charge, on said control grid in conformance with the radiation intensity of said optical image;

modulating passage of electrons through apertures in said control grid in response to the charge distribution remaining on said control grid; and storing the electrostatic image pattern resulting from modulating the passage of electrons through said apertures onto an array of conductors.

7. The method for converting an optical image into an electrostatic image of claim 6 further including the step of:

transferring at least a portion of electrostatic charge from said array of conductors to a dielectric medium.

8. Apparatus for converting an optical image into an electrostatic image comprising:

sealed housing means, a wall portion of said housing means comprising an array of conductors electrically coupling the interior of said housing means with the exterior of said housing means;

means for projecting a beam of electrons toward said array;

means for storing a predetermined electronic charge distribution between said electron projecting means and said array, said charge distribution determining the localized intensity of said electron beam impinging upon said array; and means for determining said charge distribution in accordance with said optical image.

9. Apparatus for converting an optical image into an electrostatic image comprising:

a vacuum tube housing, said housing including a surface comprised of an array of conducting members coupling the interior of said housing with the exterior of said housing;

at least one electron gun for projecting electrons toward said array of conducting members;

a control grid located between said array of conducting members and said electron gun, said control grid including a conducting portion bearing a photoconductive layer, said photoconductive layer substantially shielding said conducting surface from electrons projected by said electron gun, said control grid having a multiplicity of apertures therethrough enabling said electrons to pass and impinge on said array of conducting members; and an optical window in said housing for applying an optical image on said photoconductive portion of said control grid.

10. The apparatus for converting an optical image of claim 9 further including means for selectively charging said control grid.

11. A system for producing an electrostatographic reproduction of an optical image comprising:

means for producing a stored charge distribution determined by an applied optical image;

means for modulating an electron beam by said stored charge distribution;

an array of conductors for storing electronic charges produced by said electronic beam; said stored electronic charges comprising a latent electrostatic image of said optical image;

means for producing an image from said latent electrostatic image on a copy sheet; and means for transferring said latent electrostatic image from said array of conductors to said image producing means.

12. The system for electrostatographic reproduction of claim 11;

wherein said image transferring means includes means to transfer said stored electronic charges to a dielectric medium for subsequent transfer to said copy sheet.

13. A method of providing an electrostatic latent image from an optical image in a vacuum tube device comprising the steps of:

applying said optical image to a charged photosensitive electrode, said applied optical image determining the charge distribution on said photosensitive electrode whereby there is provided a charge distribution in image likeness to said optical image on said electrode;

modulating a beam of electrons with said charged photosensitive electrode; and accumulating charges from said modulated electron beam on a multiplicity of conducting elements, said electrode charge distribution producing charges representative of said electrostatic latent image on said conducting elements.

* * * * *